US010091862B2

(12) United States Patent
Verbrugh et al.

(10) Patent No.: US 10,091,862 B2
(45) Date of Patent: Oct. 2, 2018

(54) SYSTEM COMPRISING A CONTROLLING DEVICE AND A CONTROLLED DEVICE

(71) Applicant: PHILIPS LIGHTING HOLDING B.V., Eindhoven (NL)

(72) Inventors: Stefan Marcus Verbrugh, Eindhoven (NL); Lennart Yseboodt, Reti (BE); Matthias Wendt, Würselen (DE)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/898,265

(22) PCT Filed: May 27, 2014

(86) PCT No.: PCT/EP2014/060978

§ 371 (c)(1),
(2) Date: Dec. 14, 2015

(87) PCT Pub. No.: WO2014/198533

PCT Pub. Date: Dec. 18, 2014

(65) Prior Publication Data

US 2016/0205747 A1 Jul. 14, 2016

(30) Foreign Application Priority Data

Jun. 14, 2013 (EP) ..... 13172123

(51) Int. Cl.
*H05B 37/02* (2006.01)
*H05B 33/08* (2006.01)

(52) U.S. Cl.
CPC ..... *H05B 37/0263* (2013.01); *H05B 33/0845* (2013.01); *H05B 37/0227* (2013.01); *H05B 37/0254* (2013.01)

(58) Field of Classification Search
None
See application file for complete search history.

(56) References Cited

U.S. PATENT DOCUMENTS 6,545,586 B1 4/2003 Belliveau
2004/0160199 A1 8/2004 Morgan et al.
(Continued)

FOREIGN PATENT DOCUMENTS

CN 102548134 A 7/2012
JP 2009507355 A 2/2009
(Continued)

*Primary Examiner* — Dedei K Hammond
(74) *Attorney, Agent, or Firm* — Meenakshy Chakravorty

(57) ABSTRACT

The invention relates to a system (1) comprising a controlling device (4) like a sensor for controlling a controlled device (5) like a luminaire, a trigger unit (7) for generating a trigger signal, and an assigning unit (6) for assigning the controlling device and the controlled device to each other, if the trigger signal has been generated, wherein the controlling device controls the controlled device, if they have been assigned to each other. This allows an installer to generate assignments between the controlling device and the controlled device very easily. The installer just needs to connect the controlling and controlled devices, which should be assigned to each other, to the system and actuate the trigger unit. For instance, it can relatively easily be defined which luminaires should react on signals from which sensors.

15 Claims, 3 Drawing Sheets

(56) References Cited

U.S. PATENT DOCUMENTS

| | | | |
|---|---|---|---|
| 2008/0197790 | A1 | 8/2008 | Mangiaracina et al. |
| 2009/0152943 | A1 | 6/2009 | Diab et al. |
| 2009/0245268 | A1 | 10/2009 | Pugliese, IV |
| 2011/0178650 | A1 | 7/2011 | Picco |
| 2011/0280251 | A1 | 11/2011 | Fails et al. |
| 2012/0271477 | A1 | 10/2012 | Okubo et al. |

FOREIGN PATENT DOCUMENTS

| | | | | |
|---|---|---|---|---|
| WO | 2007102114 | A1 | 9/2007 | |
| WO | 2012028981 | A1 | 3/2012 | |
| WO | 2013057646 | A1 | 4/2013 | |
| WO | WO 2013057646 | A1 * | 4/2013 | ..... H05B 37/0227 |

* cited by examiner

SYSTEM COMPRISING A CONTROLLING DEVICE AND A CONTROLLED DEVICE

CROSS-REFERENCE TO PRIOR APPLICATIONS

This application is the U.S. National Phase application under 35 U.S.C. § 371 of International Application No. PCT/EP2014/060978, filed on May 27, 2014, which claims the benefit of European Patent Application No. 13172123.5, filed on Jun. 14, 2013. These applications are hereby incorporated by reference herein.

FIELD OF THE INVENTION

The invention relates to a system comprising a controlling device like a sensor and a controlled device like a luminaire. The invention relates further to an electrical device for being used in the system, and a method and a computer program for generating an assignment between a controlling device and a controlled device in the system.

BACKGROUND OF THE INVENTION

In a Power-over-Ethernet (PoE) lighting system luminaires are powered and controlled via Ethernet cables. Such a PoE lighting system generally further comprises sensors, wherein each sensor is assigned to a certain subgroup of luminaires, which is defined, for instance, by being located in the same room of a building. The sensor is, for example, a presence sensor for detecting the presence of persons close to the respective subgroup of luminaires such that the subgroup of luminaires can be controlled depending on whether persons are present close to the luminaires or not. A PoE lighting system of a building may comprise few thousand luminaires and few hundred sensors, wherein each subgroup of luminaires has to be assigned to one or several sensors. This assigning procedure is a very tedious task, which is generally performed by an installer when installing the PoE lighting system.

SUMMARY OF THE INVENTION

It is an object of the present invention to provide a system comprising a controlling device like a sensor and a controlled device like a luminaire, which allows for an easier generation of assignments between the controlling device and the controlled device. It is a further object of the present invention to provide an electrical device such as a switch, a controlling device like a sensor or a controlled device like a luminaire for being used in the system. Moreover, it is an object of the present invention to provide a corresponding method and computer program for generating the assignments between the controlling devices and controlled devices in a simpler way.

In a first aspect of the present invention a system is presented, wherein the system comprises:

at least one controlling device for controlling a controlled device, wherein the controlling device is a sensor, at least one controlled device to be controlled by the controlling device, wherein the at least one controlling device and the at least one controlled device are connected to the same communication network, a trigger unit for generating a trigger signal, and an assigning unit for assigning to each other a) all controlling and controlled devices which are connected to the communication network, or b) all controlling and controlled devices, which are connected to the communication network and which have not already been assigned to each other, if the trigger signal has been generated, wherein the system is adapted such that a controlling device controls a controlled device, if they have been assigned to each other.

Since the trigger unit generates a trigger signal and the assigning unit assigns the controlling and controlled devices to each other, if the trigger signal has been generated, the assignments between the controlling and controlled devices can very easily be generated by an installer, if the installer connects the controlling and controlled devices, which should be assigned to each other, to the system and actuates the trigger unit.

The system can be a single system only comprising the controlling and controlled devices, which should be assigned to each other, or it could be a subsystem being a part of a larger system, wherein during the triggering and assigning procedure the subsystem is not connected to the other parts of the larger system such that only the controlling and controlled devices of the subsystem are assigned to each other. For instance, if the subsystem is a part of a larger PoE lighting system of a building, wherein the subsystem only comprises a single sensor and some luminaires and the overall system comprises a few thousand luminaires and a few hundred sensors, the installer can firstly install the subsystem without connecting the subsystem to the overall system, then actuate the trigger unit for generating the assignments between the sensor and the luminaires of the subsystem and only then connect the subsystem to the overall system.

Generating the assignments between the controlling and controlled device can be regarded as performing a commissioning procedure such that by actuating the trigger unit an auto-commissioning procedure is initiated. The trigger unit may be actuatable by pushing a button.

The system may comprise several controlling devices and/or several controlled devices. The controlling device is a sensor. In particular, the controlling device may be a presence sensor for detecting the presence of persons or animals, a light sensor like a daylight sensor, et cetera. The controlled device may be a luminaire, an air conditioning device, et cetera. In an embodiment, a sensor is assigned to several luminaires such that the luminaires are controlled by the sensor.

The assigning unit is adapted to bind the devices assigned to each other, i.e. to logically link the devices together. The assignments may be stored by storing corresponding unique identifiers (UID) being unique for the respective controlling device or controlled device in the assigning unit or in another unit of the system.

In an embodiment the assigning unit is integrated in the at least one controlled device and/or in the at least one controlling device. Thus, it may not be necessary to provide a separate device for performing the assigning procedure. This can simplify the installation process. Moreover, the assignments may be stored in a controlling device such that the controlling device knows which controlled device is bound to the controlling device. The controlling device can then send instructions to the one or several bound controlled devices. For instance, if controlled devices bound to a controlling device being a sensor are luminaires, the sensor may instruct the bound luminaires to switch themselves on or off, or to provide a certain dim level.

In an embodiment the assignments may be stored in the at least one controlled device, wherein in this case the at least one controlling device may be adapted to broadcast an instruction for a controlled device within the system via the electrical conductors, wherein the at least one controlled device is adapted to perform the instruction, if the broadcasting controlling device has been assigned to the at least one controlled device. Moreover, in an embodiment the trigger unit is integrated in the at least one controlling device and/or the at least one controlled device. Also the integration of the trigger unit in an already present device can simplify the installation process.

It is preferred that the system further comprises a switch, wherein the trigger unit and/or the assigning unit may be integrated in the switch. Generally, after installation the switch is not easily accessible anymore, thereby reducing the likelihood of inadvertently initiating a new assignment procedure, if the trigger unit is integrated in the switch. The switch is preferentially a network switch linking, for instance, a controlling device and a controlled device and/or linking several subsystems. It may be an Ethernet switch, in particular, a PoE switch.

If the trigger unit is integrated in an electrical device like a controlling device, a controlled device or a switch, it may be adapted to generate the trigger signal, when the device is powered on for the first time. The trigger signal may be generated after a delay time. Thus, after several electrical devices have been connected to the system and after an electrical device with an integrated trigger unit has been powered on, the installer has some time, i.e. the delay time, to also power on other electrical devices, before the trigger signal is generated and the assigning procedure starts. The delay time may be some minutes, for instance, 3 minutes. However, the trigger unit can also be a further device, which is separate from a controlling device, a controlled device and a switch. For instance, it may be provided as an app running on a laptop temporally connected to the system. Also the assigning unit can be a further device, which is separate from a controlling device, a controlled device and a switch. For instance, it may be a part of, for instance, an area controller.

In an embodiment the at least one controlling device is adapted to broadcast an instruction, wherein the assigning unit is adapted to receive the instruction and send it specifically to a controlled device, if the controlled device has been assigned to the broadcasting controlling device, wherein the controlled device is adapted to perform the instruction received from the assigning unit. In this embodiment the assigning unit is preferentially a separate device being separated from the controlling and controlled devices. The controlling and controlled devices can therefore be technically relatively simple, because they do not need to provide the assignments, in particular, the assignments do not need to be stored in the controlling and controlled devices.

In an embodiment the assigning unit is adapted to assign only controlling and controlled devices of the system to each other, for which an assignment is not already present. This allows an installer to create groups and add them piece by piece to the system, wherein previously made assignments, i.e. already existing bindings, are not disturbed.

In a preferred embodiment the trigger unit is adapted to generate a reset signal, wherein the assigning unit is adapted to reset all assignments, if the reset signal has been generated. This allows the installer to correct errors in a relatively simple way by just actuating the trigger unit such that it generates the reset signal. After the reset signal has been generated, the installer can actuate the trigger unit again such that the trigger signal is generated for generating a new, correct assignment between controlling and controlled devices. The installer can disconnect a part of a larger system from the larger system and then actuate the trigger unit such that the reset signal is generated in the separated part only, in order to reset the assignments only in this part. After that the installer can actuate the trigger unit such that the trigger signal is generated in this part only, in order to generate new, correct assignments, wherein then this part can again be connected to the overall system.

The trigger unit may comprise different buttons for generating the trigger signal and the reset signal. Moreover, the trigger unit may be adapted to generate the trigger signal, if a button of the trigger unit is pushed for a relatively short time only, and to generate the reset signal, if the button is pushed for a relatively long time.

The system may be an IP system. Moreover, the system may be a communication and power distribution system, wherein within the system communication signals are transmitted and power is distributed. In this case the system may comprise a power unit for providing power to the system and electrical conductors for transmitting signals and for distributing the power within the system. The communication and power distribution system may be a PoE system, wherein the electrical conductors are Ethernet cables and the devices are PoE devices, i.e. devices to be integrated in the PoE system. However, the system can also be adapted to allow the devices of the system to wirelessly communicate with each other. Furthermore, the system can be adapted to provide a hybrid communication, i.e. a communication allowing wired and wireless communication. For instance, it can provide a heterogeneous combination of wired and wireless IP communication.

The power unit may be adapted to receive power from another power system like a mains power system and to transform the received power into a power usable by the devices of the communication and power distribution system. The power unit may be integrated in an electrical device of the system. For instance, it may be integrated in a switch of the system.

In an embodiment the system is a PoE system and the electrical conductors are Ethernet cables, wherein at least one of the at least one controlling device and the at least one controlled device is connected within the system by the Ethernet cables and another of the at least one controlling device and the at least one controlled device is connected to the at least one of the at least one controlling device and the at least one controlled device, which is connected within the system by Ethernet cables, by using another electrical conductor not being an Ethernet cable. Thus, in this embodiment the at least one controlling device or controlled device, which is connected by using another electrical conductor not being an Ethernet cable, does not need to be a PoE device. This device can therefore be technically simpler and therefore less expensive.

In a further preferred embodiment the system further comprises a display for displaying the assignments. The display may be a separate display or it may be integrated in another device like an area controller, or it may be a part of a dashboard. The installer or another person can therefore monitor the assignments and then modify the assignments, if required.

In another aspect of the present invention an electrical device for being used in the system as defined in claim 1 is presented, wherein the electrical device comprises an assigning unit for assigning to each other a) all controlling and controlled devices, which are connected to the communication network, or b) all controlling and controlled device, which are connected to the communication network and which have not already been assigned to each other, if the trigger signal has been generated. The electrical device may be a controlling device for being used in the system and for controlling a controlled device of the system, wherein the controlling device is adapted to control the controlled device, if the controlling device and the controlled device have been assigned to each other. Moreover, the electrical device may be a controlled device for being used in the system and for being controlled by a controlling device of the system, wherein the controlled device is adapted to be controlled by the controlling device, if the controlling device and the controlled device have been assigned to each other. The electrical device with the assigning unit may also be another device of the system like a switch.

In a further aspect of the present invention a method for generating an assignment between at least one controlling device and at least one controlled device in a system as defined in claim 1 is presented, wherein the at least one controlling device is a sensor, the at least one controlling device and the at least one controlled device are connected to the same communication network and the method comprises:

generating a trigger signal by a trigger unit of the system, assigning to each other a) all controlling and controlled devices, which are connected to the communication network, or b) all controlling and controlled devices, which are connected to the communication network and which have not already been assigned to each other, if the trigger signal has been generated, by an assigning unit of the system.

In another aspect of the present invention a computer program for generating an assignment between at least one controlling device and at least one controlled device in a system as defined in claim 1 is presented, wherein the computer program comprises program code means for causing the system to carry out the steps of the method as defined in claim 13, when the computer program is run on a computer controlling the system.

It shall be understood that the DC power distribution system of claim 1, the electrical device of claim 11, the method of claim 13 and the computer program of claim 14 have similar and/or identical preferred embodiments, in particular, as defined in the dependent claims.

It shall be understood that a preferred embodiment of the invention can also be any combination of the dependent claims with the respective independent claim.

These and other aspects of the invention will be apparent from and elucidated with reference to the embodiments described hereinafter.

DETAILED DESCRIPTION OF EMBODIMENTS

Figure 1:
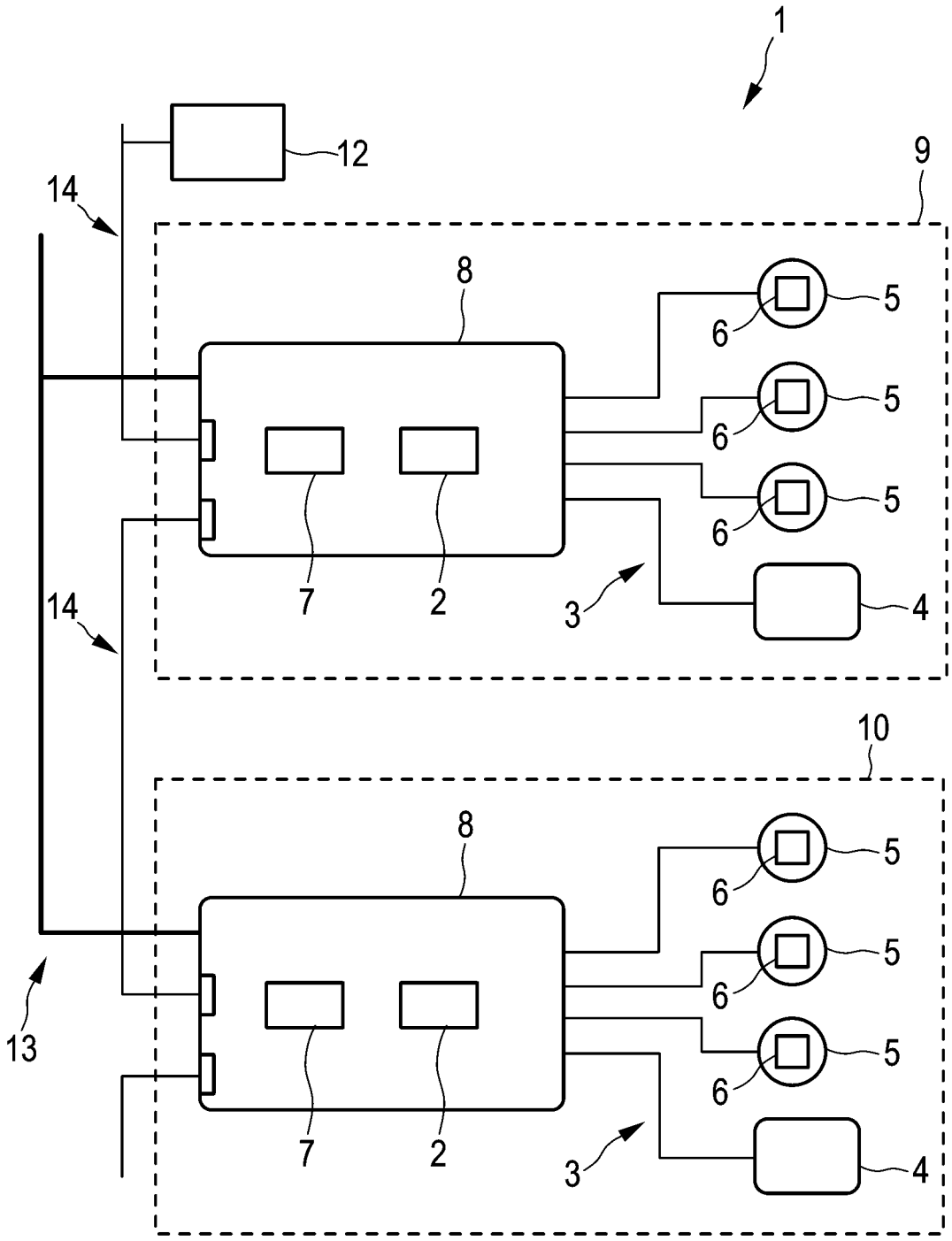
FIG. 1 shows schematically and exemplarily an embodiment of a communication and power distribution system.

FIG. 1 shows schematically and exemplarily a communication and power distribution system 1 comprising first and second subsystems 9, 10. In this embodiment the system 1 is a PoE lighting system. Each subsystem 9, 10 comprises a switch 8, luminaires 6 and a sensor 4. The luminaires 6 and the sensor 4 are connected to the respective switch 8 via Ethernet cables 3. Each switch 8 comprises a power unit 2 for providing power to the respective subsystem 9, 10, in particular, to the luminaires 6 and the sensor 4 of the respective subsystem 9, 10. The power unit 2, which may also be regarded as being a power supply unit, is adapted to receive mains power from mains conductors 13 and to transform the mains power to a power usable by the luminaires 5 and the sensor 4 of the respective subsystem 9, 10. The switches 8 are connected to each other and are connected with further network devices, in particular, with further switches, not shown in FIG. 1 via Ethernet conductors 14. Also the Ethernet conductors 14 are preferentially Ethernet cables.

For assigning the luminaires 5 of a subsystem 9, 10 to the sensor 4 of the same subsystem 9, 10 the respective subsystem 9, 10 is disconnected from the overall system 1. In this situation, in which the respective subsystem 9, 10 is separated from the remaining part of the overall system 1, a trigger unit 7 of the switch 8 can generate a trigger signal within the separated respective subsystem 9, 10 and assigning units 6 of the luminaires 5 of the same subsystem 9, 10 can assign the sensor 4 and the luminaires 5 of the same subsystem 9, 10 to each other, after the trigger signal has been generated. After for each subsystem 9, 10 the assignment procedure has been completed, the subsystems 9, 10 can be connected to each other, i.e. in FIG. 1 the switches 8 can be connected via the Ethernet conductors 14. The system 1 is adapted such that the luminaires 5 are controlled by the respective sensor 4, to which the luminaires 5 have been assigned.

The sensors 4 are preferentially presence sensors for detecting whether persons or animals are close to the respective sensor 4, wherein the sensor 4 and the luminaires 5 of a same subsystem 9, 10 are arranged close to each other, in particular, within a same room of a building. Thus, an installer can install sensors and luminaires room-by-room, wherein the installer can firstly connect all luminaires and sensors to switches of an actual room and actuate the trigger unit, before connecting the one or several switches, luminaires and sensors of the actual room to the overall system, in order to assign the sensors and luminaires of the current room to each other.

The assignments are stored in the assigning units 6 by storing corresponding UIDs being unique for the respective luminaire 5 or sensor 4. The luminaires 5 and sensors 4 are PoE devices, i.e. they are configured to be integrated in the PoE system.

After the assignments have been generated and stored, the sensor 4 of the respective subsystem 9, 10 can broadcast an instruction for the luminaires 5 of the same subsystem 9, 10 within the complete system 1 via the Ethernet cables 3, wherein the luminaires 5 of the overall system 1 only perform the instruction, if the broadcasting sensor 4 has been assigned to the respective luminaire 5 as indicated by the assignments stored in the respective assigning unit 6 of the respective luminaire 5.

The trigger unit 7, i.e. in this embodiment the respective switch 8 in which the respective trigger unit 7 is integrated, comprises a push button, wherein the trigger signal is generated, when the installer pushes the button. Additionally or alternatively the trigger unit 7 may be adapted to automatically generate a trigger signal, if the respective switch 8 is powered on for the first time.

The system 1 further comprises a display 12 for displaying the assignments. The display 12 may be integrated in an area control unit, a building management system, et cetera. The display 12 can also be a standalone display or it can be a part of a dashboard. The display 12 can receive the assignments from the assigning units 6 via the switches 8.

In a further embodiment the assigning units 6 may not be integrated in the luminaires 5, but they may be integrated in the sensors 4. In this case the assignments are stored in the sensors 4 such that the sensors 4 know which luminaires 5 are bound to the respective sensor 4. The sensor 4 can then send instructions to the luminaires 5 bound to the respective sensor 4. For instance, the sensor 4 may instruct the bound luminaires 5 to switch themselves on or off or to provide a certain dim level.

In a further embodiment the assigning units 6 may be integrated in the switches 8. Moreover, the trigger unit 7 may not be integrated in the respective switch 8, but in a sensor 4 or one or several luminaires 5. The trigger unit 7 and/or the assigning unit 6 can also be separate units, wherein each subsystem may comprise one trigger unit and one assigning unit. For instance, the trigger unit may be provided as an app running on a laptop temporally connected to the respective subsystem. Furthermore, the assigning unit may be integrated in an area controller controlling an area covered by the respective subsystem. If the assigning unit 6 is not integrated in the luminaires 5, the sensor may be adapted to broadcast an instruction, wherein the assigning unit 6 not integrated into a luminaire 5 may be adapted to receive the instruction and send the instruction specifically to the one or several sensors 5, which have been bound to the broadcasting sensor 4, wherein a respective luminaire 5 is adapted to perform the instruction received from the assigning unit.

PoE is a standardized way to transfer power to a device, which is fully compatible with the Ethernet data communication. The PoE system has the advantage that the power and the control data or other signals can be transmitted via the same Ethernet cable. It is therefore not necessary to install separate cables for power and data transmission. The Ethernet cables are preferentially Cat5 cables. However, also other Ethernet cables can be used like Cat6 or Cat7 cables.

Although in FIG. 1 only two switches are shown, the system can also comprise more switches, wherein power is transmitted from the switches to the luminaires and sensors and signals are transmitted between the luminaires, sensors and switches by using Ethernet cables. Although in FIG. 1 to each switch four luminaires are connected, also more or fewer luminaires can be connected to a single switch. Preferentially 4 to 48 luminaires are connected to a single switch. The switches may be daisy chained as shown in FIG. 1 or they may be connected in another way, in particular, connected with an uplink to a higher tear set of switches. Moreover, although in FIG. 1 the respective switch is connected to luminaires, the respective switch can also be connected to other PoE devices like cameras, VoIP phones, computer monitors, et cetera.

Each luminaire 5 preferentially comprises a driver to apply the right current and voltage to the respective light source of the luminaire. The luminaires 5 preferentially comprise light emitting diodes (LED) as the light source. The driver is preferentially dimmable and equipped with a microcontroller and Ethernet transceiver. The respective luminaire 5 can therefore be connected to the system and fully controlled over an IP based protocol via the respective driver. Also the sensors 4 preferentially comprise drivers equipped with a microcontroller and Ethernet transceiver for providing the described functions.

Although in the embodiment described above with reference to FIG. 1 the controlling device of the system is a sensor, in another embodiment the controlling device can also be another device like a user interface. The user interface can be a personal computer that is connected to the respective switch via an Ethernet cable and that runs corresponding software to generate commands for the luminaires like a dimming command, a switching on command, a switching off command, et cetera. The user interface can also be another device like a switching device, which may be mounted on a wall of a room, wherein the switching device may be adapted to provide control data for the luminaires via the Ethernet connection.

Although in the embodiment described above with reference to FIG. 1 to each switch 8 a sensor 4 is connected, in another embodiment at least one switch may not have a sensor connected to it, wherein in this case the luminaires connected to this switch may be assigned to one or more sensors that are connected to another switch, i.e. the luminaires connected to the switch without sensor can be assigned to one or several sensors connected to another switch. Moreover, one or several luminaires can be assigned to more than one sensor, wherein in this case the luminaires react on a sensor generated command, if one of the sensors initiates a corresponding command, in particular, if one of the sensors detects an event.

In large buildings the network of switches, luminaires and sensors can be quite large. For instance, a network can comprise up to a few hundred sensors, a few hundred switches and a few thousand luminaires. Preferentially these switches, luminaires and sensors form one network, i.e. one communication and power distribution system, wherein during the assigning procedures subsystems can be disconnected from the overall system. If finally all switches, luminaires and sensors form one network, certain functions can be performed for all luminaires in the whole building in a relatively easy way. For instance, all luminaires can easily be switched off independently from any sensor information, especially during the night. Moreover, all luminaires can be switched on independently from any sensor information, especially during normal working hours in an office. It is also possible to send a command to all luminaires that they should switch on and off according to sensor information, especially during hours in which the building is in use, but only a limited number of persons is present in the building. Furthermore, maintenance information like LED failures can very easily be received from all luminaires. Also information about power consumption can be retrieved in a simple way from the system. Moreover, a testing of an emergency light function can be performed for all luminaires in a relatively easy way, if all luminaires and switches are components of the same network.

However, the assignments of the sensors to the luminaires are more localized. For instance, 1 to 30 luminaires and 1 to 4 switches, to which the luminaires may be connected, may be located close to each other in the building, wherein at least one sensor may be assigned to the 1 to 30 luminaires. If an event is detected by the at least one sensor, only the luminaires that are assigned to, i.e. commissioned to, this at least one sensor will react to the commands that the sensor sends on the network, i.e. on the system.

The automatic assignment procedure, i.e. the auto-commissioning procedure, described above with reference to FIG. 1 particularly offers a solution for use cases where the functions that use the full scope of the network have limited complexity like the above described functions such as switching on or off all luminaires at certain times of the day, but where a proper assignment of certain luminaires to certain sensors is important. Generally, it would also be possible to generate the assignments between luminaires and sensors with additional tools like remote controls or devices that can detect coded light. But, assigning certain sensors to certain luminaires in this way is a lot of work and/or requires dedicated tools. Furthermore, it requires a skilled person to do this commissioning. In contrast, the assigning procedure described above with reference to FIG. 1 enables a fast commissioning of sensors, which is very easy for an installer and can therefore be performed by any installer.

The respective subsystem, which in the described embodiments is a PoE lighting subsystem and which comprises the trigger unit and the assigning units, is adapted to assign luminaires to sensors at a certain point in time during installation by giving a trigger to the subsystem, where upon all luminaires present in the subsystem are assigned to all sensors present in the subsystem. This only happens, as mentioned, in the subsystem, i.e. in the network segment, where the trigger unit itself is connected to. This enables an installer to install and commission luminaires and sensors by the following steps. Firstly, the installer can connect all luminaires that should react to the same at least one sensor and the at least one sensor to the same network segment, i.e. to the same subsystem. Then, the installer can initiate the trigger by actuating the trigger unit, which is also connected to the same network segment, such that the trigger signal is generated within the same network segment. When the trigger signal has been generated, the assigning unit runs a process that commissions every sensor to every luminaire connected to the same network segment. This procedure can be repeated for different network segments, for instance, in different rooms or different areas, in order to assign further luminaires and sensors to each other. After all luminaires and sensors have been installed and commissioned in this way, the network segments, i.e. the subsystems, are coupled to each other to form one Ethernet network, i.e. one overall system, in order to enable functions, which need the communication to the whole system, like switching on or off all luminaires at certain times. The assignment procedure even allows assigning luminaires that are connected to the same switch to different sensors. If this is desired, luminaires connected to a switch, which should, during the actual assigning procedure, not be assigned to at least one sensor connected to the present network segment, should be temporally disconnected during initiating the trigger event.

Preferentially, only a single device in the respective subsystem is able to provide the trigger signal. If the trigger unit is integrated in another device, the push button of the trigger unit may be a push button of the other device, wherein the trigger signal may be generated, when the push button is pressed. For instance, a sensor, a luminaire or a switch may comprise such a push button, which allows an installer to initiate the trigger process. The trigger unit may also be an Ethernet device that is temporally connected to the network or it may be integrated in such a temporally connected Ethernet device. For example, the trigger unit may be implemented as an app running on a laptop or it may be in the form of a dedicated trigger device having a push button for initiating the trigger process.

After the trigger signal has been generated, the assigning unit performs the auto-commissioning procedure, i.e. the creation of bindings, on the respective subsystem. A binding may be defined by a logical link between two devices, for instance, a sensor may be bound to a luminaire meaning that the luminaire will act on sensor events. A binding may be performed by storing the logical link in the assigning unit by using a UID. If the assigning unit is integrated in another device like a luminaire, sensor or switch, the respective logical link may be stored in this respective device. Thus, if the assigning unit is integrated in a controlling device like the sensor or a user interface, the controlling device knows which luminaires are bound to it. It can therefore contact the luminaires bound to it by sending instructions to them, if an action needs to be performed. If the binding information is stored in the controlled device, for instance, in the luminaire, the controlling device may simply broadcast the respective instructions on the entire system, wherein, if a controlled device receives the broadcast instructions, it decides what to do with the instructions depending on whether the respective controlled device has been bound to the broadcasting controlling device. For instance, the respective controlled device can ignore the received instructions, if the broadcasting controlling device is not bound to the respective controlled device. However, if the respective controlled device is bound to the broadcasting controlling device as indicated by the binding information stored in the respective controlling device, the respective controlling device will act as defined in the received instructions. If the assigning unit is a separate device or integrated in a separate device, i.e. a device not being a controlling device like a sensor or a controlled device like a luminaire, the binding information may be stored in the separate device, which may be a central server, an area controller, et cetera. Also in this case the controlling device is preferentially adapted to broadcast its instructions on the overall system, wherein the separate device receives the instructions, may translate these instructions to commands understandable by the controlled devices bound to the broadcasting controlling device and may send the commands to the respective controlled devices. In this example the controlling device can also be adapted to not broadcast its instructions, but to directly send its instructions to the separate device, which then sends corresponding commands to the bound controlled devices.

In above described embodiments the trigger unit and the assigning unit are integrated in certain electrical devices of the system such that these electrical devices generate the trigger signal and generate the assignments between the controlling devices and the controlled devices, if the trigger signal has been generated. However, the trigger unit and the assigning unit can also be integrated in other electrical devices. Moreover, the assigning unit may also be regarded as being a distributed unit, wherein different substeps of the assignment procedure are performed by different subunits integrated into different devices. For instance, the assignment procedure can comprise at least three substeps: scanning the respective network segment for controlling devices and controlled devices, assigning the scanned controlling devices and controlled devices to each other and storing the assignments. These three substeps can be performed by a single assigning unit, which may be integrated in a certain electrical device, or they may be performed by several subunits of a distributed assigning unit, which are integrated in different electrical devices.

In an embodiment a system comprises a network with sensors as controlling devices, luminaires as controlled devices and PoE switches connected together through the Ethernet, i.e. connected together by using Ethernet cables. The trigger unit and the subunits for scanning the network for sensors and luminaires and for assigning the scanned luminaires and sensors to each other are integrated in a PoE switch and subunits for storing the assignments, i.e. the bindings, are integrated in the luminaires. In this case, after an installer has connected several luminaires and sensors to, for instance, two PoE switches, which are not connected to an overall system like a company network yet, the installer may press an auto-commissioning button on a PoE switch such that the PoE switch generates a trigger signal, which causes the integrated subunits of the switch to scan the network segment, i.e. the subsystem, for devices and to create two lists, a first list Lsensor containing the UIDs of all sensor devices and a second list Llum containing the UIDs of all luminaires. The switch may then iterate over Llum and add each UID in Lsensor to each luminaire in Llum for binding all sensors and luminaires within the actual network segment together. The bindings are finally stored in the luminaires comprising the corresponding subunits of the assigning unit being, in this embodiment, storing units.

In a further embodiment the system may also comprise sensors as controlling devices, luminaires as controlled devices and PoE switches, wherein these components are connected through the Ethernet, in particular, by Ethernet cables. During installation the installer may have connected several luminaires and sensors to two PoE switches, which are not connected to the overall system yet, which may be company network. In this example the trigger unit and the assigning unit are integrated in a sensor. Thus, an installer may press an auto-commissioning button on a sensor, whereupon the sensor generates a trigger signal and scans the network for devices. Moreover, the sensor creates two lists, a first list Lsensor containing the UIDs of all connected sensor devices and a second list Llum containing the UIDs of all connected luminaires. The sensor then adds all luminaires to its own binding list. The sensor iterates over Lsensor and instructs every sensor to bind itself to all the UIDs in Llum for binding all connected sensors and luminaires together. The resulting bindings are stored in the sensors.

In a further embodiment the trigger unit and the subunits for scanning the network and generating the assignments can be integrated in, for instance, the luminaire or an area controller, wherein in the first case the luminaire scans for devices on the network and binds them together and in the second case the area controller scans for devices on the network and creates the bindings. Generally, the bindings can be stored in any device of the system, for instance, in one or several luminaires, in one or several sensors, in a separate trigger unit, in a separate assigning unit or in another separate unit, i.e. a unit not being a luminaire or a sensor. Moreover, in an embodiment the switch is completely standard and the triggering and assigning functions are implemented in the other devices of the system, for instance, in at least one controlling device and/or at least one controlled device.

The auto-commissioning procedure described above with reference to, for instance, FIG. 1 allows to commission sensors and luminaires by just requiring the installer to actuate the trigger unit, for instance, to press a single button or to just power on a device for the first time. A disadvantage of the auto-commissioning procedure described above with reference to FIG. 1 might be that for every logical group the installer must fully isolate the respective devices from the rest of the system. A mistake here would cause a binding of a large number of devices. In a further embodiment the auto-commissioning procedure is therefore preferentially adapted such that luminaires and/or sensors, which have already been involved in a binding, are rejected during the binding process. This allows the installer to create groups and add them piece by piece to the network. Devices, which have been prebound, will not be disturbed by new auto-commissioning procedures.

Thus, the assigning units 6 may be further adapted to assign only sensors 4 and luminaires 5 to each other, for which an assignment is not already present. For instance, after the assignments between the sensor 4 and the luminaires 5 of the first subsystem 9 have been generated, the second subsystem 10 can be connected to the first subsystem 9 and the assignments between the sensor 4 and the luminaires 5 of the second subsystem 10 can be generated, without disturbing the already present assignments between the sensor 4 and the luminaires 5 of the first subsystem 9, although the first and second subsystem 9, 10 are connected to each other. This allows the installer to add further subsystems to the subsystems, for which assignments have already been generated, step-by-step, wherein during generating assignments for a certain subsystem the certain subsystem can be connected to other subsystems, for which the assignments have been generated already.

To explain this aspect with a further example, an installer may have connected several luminaires and sensors to two switches, which are connected together via the Ethernet, but which are not connected to the overall system yet. In this example the two Ethernet switches are also connected to six switches that have already been auto-commissioned. If in this example the trigger unit is integrated in one of the eight switches, the installer may actuate the trigger unit by, for instance, pressing a corresponding button on the respective switch. Moreover, if in this example the assigning unit is also integrated in the respective switch, the switch will scan the network for devices and create two lists, Lsensor containing the UIDs of all sensors and Llum containing the UIDs of all luminaires, after the trigger signal has been generated. The switch will iterate over all luminaires in Llum and will read their binding lists. If the switch finds a UID in the binding list that matches a UID in Lsensor, the corresponding sensor is removed from Lsensor. If the binding list of the respective luminaire is not empty, the luminaire will be removed from Llum. The switch then iterates over Llum and adds every UID in Lsensor to every luminaire in Llum, thereby all "new" sensors and luminaires, which had not already been assigned during a previous auto-commissioning step, are now bound together in a new logical group. In a further embodiment it is stored, for example, in the assigning unit which sensors and luminaires have been commissioned yet, wherein this information may be used, in order to ensure that sensors and devices, for which an auto-commissioning procedure has been performed already, take not part at a further auto-commissioning procedure.

Moreover, if an assigning unit of an overall system is adapted to assign only controlling and controlled devices of the system to each other, for which an assignment is not already present, if this overall system already comprises controlling devices and controlled devices bound to each other and if new controlling and controlled devices have been added to the overall system, the trigger signal can be generated, in order to only assign the new controlling and controlled devices to each other.

In an embodiment the system may be adapted such that, if the trigger unit is actuated for a longer period of time, for instance, if a push button of the trigger unit is pressed for a longer period of time, the whole system is reset, i.e. all binding information in every device of the respective overall system or subsystem is cleared. With this procedure the installer can selectively delete bindings by wiring erroneously configured devices into one logical group and triggering the reset in that group. If the system is implemented with first time power on as a trigger, the binding list in a device can be reset by powering this device from a switch or from a network of switches that does not have the combination of luminaires and sensors defined in the binding list connected to it.

Thus, the trigger units 7 can be further adapted to generate a reset signal, wherein the assigning units 6 can be adapted to reset all assignments, if the reset signal has been generated. This allows the installer to remove incorrect assignments. For instance, if assignments in the first subsystem 9 are incorrect, the installer can disconnect the first subsystem 9 from the overall system 1, in particular, from the second subsystem 10, actuate the trigger unit 7 of the switch 8 of the first subsystem 9 to generate the reset signal and then actuate the trigger unit 7 of the switch 8 of the first subsystem 9 to generate the trigger signal, in order to generate new, correct assignments for the first subsystem 9. The trigger unit 7, i.e. in this embodiment the switch 8 with the integrated trigger unit 7, can comprise at least two buttons, one button for generating the trigger signal and a further button for generating the reset signal. The trigger unit 7 can also comprise other input units allowing the installer to indicate which signal should be generated by the trigger unit 7. The trigger unit 7 may also just comprise a single button for generating the trigger signal and for generating the reset signal, wherein the reset signal may be generated only, if the button is pressed for a time being longer than a predefined threshold. If the button is pressed for a shorter time, the trigger signal may be generated.

Figure 2:
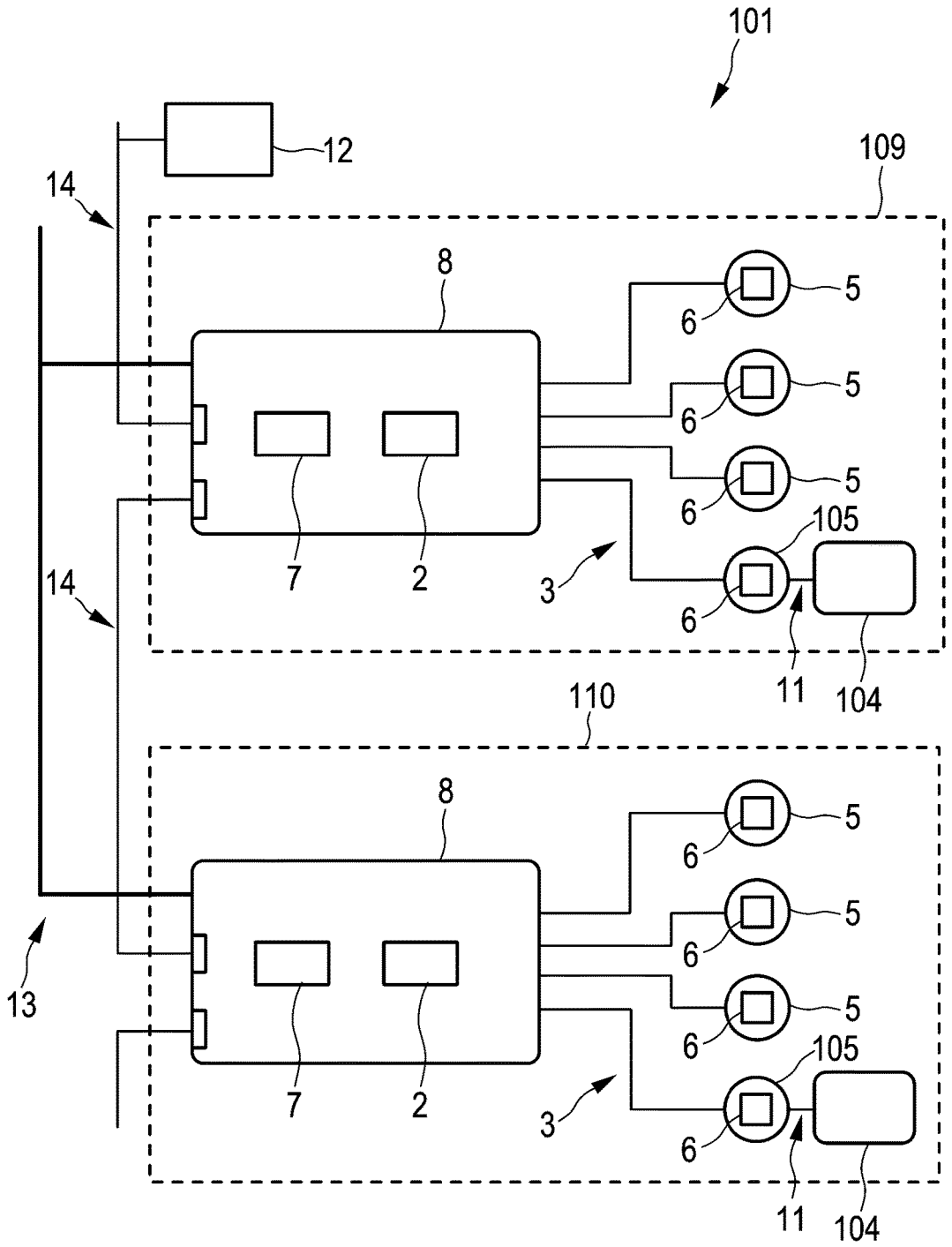
FIG. 2 shows schematically and exemplarily a further embodiment of a communication and power distribution system.

A further embodiment of a communication and power distribution system 101 is schematically and exemplarily shown in FIG. 2. The system 101 illustrated in FIG. 2 is similar to the system 1 illustrated in FIG. 1, except for the connection of the sensors 104, i.e. in this embodiment the sensors 104 are not directly connected to the respective switch 8, but via a luminaire 105, wherein the conductor between the sensor 104 and the luminaire 105 is not an Ethernet conductor, for example, not an Ethernet cable. Since the sensor 104 is not directly connected to the Ethernet, but connected to one of the luminaires 105 with a different interface, the sensor 104 requires less expensive components than Ethernet and PoE devices. Moreover, the sensor 104 only needs a very small amount of power. In this example the trigger unit and the assigning unit are not included in the sensor 104, but included in other devices of the system 101, in particular, in the switches 8 and the luminaires 5, 105.

Figure 3:
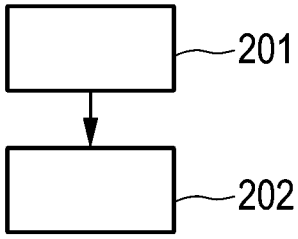
FIG. 3 shows a flowchart exemplarily illustrating a method for generating an assignment between a controlling device and a controlled device in a communication and power distribution system.

In the following an embodiment of a method for generating an assignment between a controlling device and a controlled device in a communication and power distribution system will exemplarily be described with reference to a flowchart shown in FIG. 3.

In this embodiment the system is a subsystem of a larger overall system, wherein an installer has connected a sensor and several luminaires to this subsystem. In step 201 a trigger signal is generated by a trigger unit of the subsystem. The trigger unit may be integrated in the sensor, one of the luminaires or another device of the subsystem like a switch and it may comprise a push button such that the installer may actuate the trigger unit for generating the trigger signal by pressing the push button on, for instance, the sensor, a luminaire or another device like the switch. In step 202 the sensor and the luminaires of the subsystem are assigned to each other. In particular, the assigning unit scans the subsystem for all luminaires and the sensor and logically links the sensor with the luminaires for generating the assignments, which are stored in the assigning unit. The assigning unit may be integrated in one or several devices of the subsystem such that the respective one or several devices may perform step 202. After the sensor and the luminaires of the subsystem have been assigned to each other, i.e. after they have been auto-commissioned, steps 201 and 202 may be repeated with respect to another subsystem of the overall system.

If the trigger unit and the assigning unit are not integrated in the same device, the trigger signal may be sent from the trigger unit to the assigning unit via, for instance, an Ethernet cable. If the trigger unit and at least a part of the assigning unit like a subunit for scanning the network are integrated in the same electrical device, the trigger signal generated by the trigger unit may just be an internal signal, which is generated by, for instance, pushing a button on the electrical device, powering on the electrical device for the first time or another trigger event, wherein the generation of the trigger signal prompts the assigning unit to perform the assigning procedure.

Although in above described embodiments the communication network is a wired communication network, in other embodiments the communication network can also be a wireless communication network or a heterogenous wired and wireless communication network.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

A single unit or device may fulfill the functions of several items recited in the claims. The mere fact that certain measures are recited in mutually different dependent claims does not indicate that a combination of these measures cannot be used to advantage.

Procedures like the generation of the trigger signal, the scanning of the devices in a system, in particular, in a subsystem, the generation of the assignments between the scanned devices, the storing of the generated assignments, et cetera performed by one or several units or devices can be performed by any other number of units or devices. For example, steps 201 and 202 can be performed by a single unit or by any other number of different units. In particular, the triggering, scanning, assigning and storing procedures can be distributed over several devices of the system. These procedures and/or the control of the above described systems in accordance with the above described method can be implemented as program code means of a computer program and/or as dedicated hardware.

A computer program may be stored/distributed on a suitable medium, such as an optical storage medium or a solid-state medium, supplied together with or as part of other hardware, but may also be distributed in other forms, such as via the Internet or other wired or wireless telecommunication systems.

Any reference signs in the claims should not be construed as limiting the scope.

The invention relates to a system comprising a controlling device like a sensor for controlling a controlled device like a luminaire, a trigger unit for generating a trigger signal, and an assigning unit for assigning the controlling device and the controlled device to each other, if the trigger signal has been generated, wherein the controlling device controls the controlled device, if they have been assigned to each other. This allows an installer to generate assignments between the controlling device and the controlled device very easily. The installer just needs to connect the controlling and controlled devices, which should be assigned to each other, to the system and actuate the trigger unit. For instance, it can relatively easily be defined which luminaires should react on signals from which sensors.

The invention claimed is:

1. A system comprising:

at least one controlling device, wherein said at least one controlling device is a sensor, at least one controlled device, wherein said at least one controlled device is an electrical device and wherein said at least one controlling device and said at least one controlled device are connected to the same communication network, a trigger unit for generating a trigger signal, and an assigning unit for assigning all unassigned controlling devices of the at least one controlling device to corresponding unassigned controlled devices of that at least one controlled device in response to determining that at least one of said unassigned controlling devices is connected to the communication network if the trigger signal has been generated, wherein the system is adapted such that a given controlling device of said at least one controlling device controls a given controlled device of said at least one controlled device, if the given controlling device has been assigned to the given controlled device.

2. The system as defined in claim 1, wherein said assigning unit is integrated in said at least one controlled device and/or in said at least one controlling device.

3. The system as defined in claim 2, wherein the assignments are stored in said at least one controlled device, wherein a particular controlling device of said at least one controlling device is adapted to broadcast an instruction for a particular controlled device of said at least one controlled device within the system via electrical conductors, wherein said particular controlled device is adapted to perform the instruction, if the broadcasting controlling device has been assigned to said particular controlled device.

4. The system as defined in claim 1, wherein said trigger unit is integrated in said at least one controlling device and/or said at least one controlled device.

5. The system as defined in claim 1, wherein the system further comprises a switch, wherein said trigger unit and/or said assigning unit are integrated in said switch.

6. The system as defined in claim 1, wherein a particular controlling device of said at least one controlling device is adapted to broadcast an instruction, wherein said assigning unit is adapted to receive the instruction and send it specifically to a particular controlled device of said at least one controlled device, if said particular controlled device has been assigned to the broadcasting controlling device, wherein said particular controlled device is adapted to perform the instruction received from said assigning unit.

7. The system as defined in claim 1, wherein said trigger unit is adapted to generate a reset signal, wherein said assigning unit is adapted to reset all assignments, if said reset signal has been generated.

8. The system as defined in claim 1, wherein the system further comprises a power unit for providing power to the system and electrical conductors for transmitting signals and for distributing the power within the system.

9. The system as defined in claim 8, wherein the system is a Power-over-Ethernet system and said electrical conductors are Ethernet cables, wherein at least one of said at least one controlling device and said at least one controlled device is connected within the system by the Ethernet cables and another of said at least one controlling device and said at least one controlled device is connected to said at least one of the at least one controlling device and said at least one controlled device, which is connected within the system by Ethernet cables, by using another electrical conductor not being an Ethernet cable.

10. The system as defined in claim 1, wherein the system further comprises a display for displaying the assignments.

11. An electrical device for use with a system comprising at least one controlling device, wherein said at least one controlling device is a sensor, and at least one controlled device, wherein said at least one controlled device is electrical and wherein said at least one controlling device and said at least one controlled device are connected to the same communication network, the electrical device comprising:

an assigning unit for assigning all unassigned controlling devices of said at least one controlling device to all unassigned controlled devices of said at least one controlled device in response to determining that at least one of said unassigned controlling devices is connected to the communication network if a trigger signal has been generated, wherein said system is adapted such that a given controlling device of the at least one controlling device controls a given controlled device of said at least one controlled device if the given controlling device has been assigned to the given controlled device.

12. The electrical device as defined in claim 11, wherein the electrical device is a particular controlling device of said at least one controlling device or is a particular controlled device of said at least one controlled device.

13. A method for generating an assignment between at least one controlling device and at least one controlled device in a system, wherein the at least one controlling device is a sensor, the at least one controlled device is an electrical device, the at least one controlling device and the at least one controlled device are connected to the same communication network and the method comprises:

generating a trigger signal by a trigger unit of the system, assigning all unassigned controlling device of the at least one controlling device to corresponding unassigned controlled devices of at least one controlled device in response to determining that at least one of said unassigned controlling device is connected to the communication network, if the trigger signal has been generated, by an assigning unit of the system.

14. A non-transitory storage medium comprising a computer program that when executed is configured to perform the method of claim 13, when the computer program is run on a computer controlling the system.

15. A system comprising:

at least one controlling device, wherein said at least one controlling device is a sensor, at least one controlled device, wherein said at least one controlled device is an electrical device and wherein said at least one controlling device and said at least one controlled device are connected to the same communication network, a trigger unit for generating a trigger signal, and an assigning unit for assigning all unassigned controlling devices of the at least one controlling device to corresponding unassigned controlled devices of the at least one controlled device which are connected to the communication network, if the trigger signal has been generated, wherein the assigning comprises rejecting an assignment of at least one given controlled device in response to determining that the given controlled device has been assigned, wherein the system is adapted such that a particular controlling device of the at least one controlling device controls a particular controlled device of the at least one controlled device, if the particular controlling device has been assigned to the particular controlled device.

* * * * *